US005200573A

United States Patent [19]

Blood

[11] Patent Number: 5,200,573

[45] Date of Patent: Apr. 6, 1993

[54] PROJECTILE HAVING A MATRIX OF CAVITIES ON ITS SURFACE

[76] Inventor: Charles L. Blood, No. 1 Farview Ave., Atlantic Highlands, N.J. 07716

[21] Appl. No.: 706,387

[22] Filed: May 28, 1991

[51] Int. Cl.[5] ..... F42B 6/00

[52] U.S. Cl. ..... 102/501; 273/232

[58] Field of Search ..... 273/62, 232; 102/448, 102/501, 529

[56] References Cited

U.S. PATENT DOCUMENTS

| | | | |
|---|---|---|---|
| 1,716,435 | 6/1929 | Fotheringham | 273/232 |
| 2,728,576 | 12/1955 | Martin et al. | 273/232 |
| 4,173,930 | 11/1979 | Faires, Jr. | 102/448 |
| 4,804,189 | 2/1989 | Gobush | 273/232 |
| 4,858,929 | 8/1989 | Gobush et al. | 273/232 X |
| 4,996,924 | 3/1991 | McClain | 102/501 |

FOREIGN PATENT DOCUMENTS

| | | | |
|---|---|---|---|
| 187572 | 2/1964 | Sweden | 102/501 |

*Primary Examiner*—William H. Grieb

*Attorney, Agent, or Firm*—Daniel E. Kramer

[57] ABSTRACT

An improved aerodynamic surface for the exterior of vehicles moving through a gas and vehicles employing such improved surfaces. The objectives of employing such improved surfaces are reduced air resistance and increased lift.

The improved surface comprises a series of dimples or depressions formed into the portions of the surface of the vehicle. The improved surface is most beneficially located either at a leading edge, where the vehicle first cleaves the pool of air through which it is traveling, or on vehicle surfaces which tend to move the air pool to accommodate the presence of the vehicle itself or on vehicle surfaces to which the designer wishes to provide a lift function. Wings, ailerons and rudder surfaces are examples of surfaces to which a lift function is most applicable. The vehicle may be of the nature of an automobile, an airplane, a rocket or missile or a projectile fired from a gun. The invention is also applicable to the internal surface of pipes for conveying fluid.

5 Claims, 2 Drawing Sheets

PROJECTILE HAVING A MATRIX OF CAVITIES ON ITS SURFACE

BACKGROUND OF THE INVENTION

1. Field of the Invention

The present invention relates generally to surfaces which interface with a fluid such as a gas or liquid under conditions where there is relative motion between the fluid and the surface. More particularly the invention relates to the application of dimples or cavities to such surfaces. Still more particularly, the invention relates both to vehicles which are intended to move within a fluid and to the application of dimples to their external surfaces which interface with the fluid through which the vehicle moves, and to conduits within which fluids flows and to the application of dimples to their internal surfaces which interface with the flowing fluid.

For the purposes of this specification the term vehicle is intended to include internally or externally powered objects as diverse as automobiles, boats including the displacement, planing and hydrofoil types and airplanes, fans and propellers, bullets and artillery shells all of which have surfaces which move relative to one or more fluids; and to objects which move within a relatively dense gas at one time and in a vacuum or highly rarified gas at other times.

Within this specification the terms air and gas will be employed interchangeably to refer to a single gas or a mixture of gasses including but not restricted to air and all its constituent gasses and to any other gas or gas-like material which moves relative to a surface. The term fluid will be employed to refer to any liquid or any gas.

The term lost energy is not intended to imply that energy is lost but simply that energy of motion is converted to another form of energy such as heat.

2. Background of the Invention

Whenever energy is used either to propel a vehicle through a fluid or to propel a fluid through a conduit, there is energy lost because of friction between the surface and the fluid moving relative to it. The lost energy is generally evidenced by conversion of the energy lost to heat and by a slowing of the vehicle or by a pressure drop of the fluid flowing through the conduit. The lost energy must be constantly replaced to maintain the speed of the vehicle or to maintain the pressure of the fluid. In a vehicle, replacing the lost energy is achieved by supplying power to the wheels or other propelling agency such as a propeller or jet engine. In a conduit the lost energy is replaced either by increasing the initial pressure of the fluid being pumped through a conduit or by providing pumping means spaced at intervals along a pipe or conduit to increase to a higher level the pressure which had dropped to a lower level through friction.

To the extent that friction between a surface and a fluid flowing relative to the surface can be reduced, the energy required to move the vehicle through the fluid or the fluid through the conduit can be reduced. Such an energy reduction will be represented by an increase in gas mileage and range in an internally powered vehicle such as a car or boat or plane or rocket or by an increase in range of an externally powered vehicle such as an artillery shell or bullet.

Further, lift is generated by fluid flow over dimpled surfaces as compared with fluid flow over similarly contoured smooth or undimpled surfaces. The lift is generated because fluid, traversing the dimpled surface, must travel further over the dimples than over a corresponding contoured smooth surface, thereby generating higher fluid velocity and lower pressure adjacent the dimpled surface, in accord with Bernoulli's theorem, whereby lift is generated by the differential pressure between the lower pressure adjacent the surface having the dimples and the higher pressure on the corresponding undimpled or smooth surface positioned on the vehicle oppositely to the dimpled surface.

3. Related Art

The only related art known to me is a golf ball which has a dimpled surface. A typical golf ball is 1.67 inches in diameter (42.5 mm) and has distributed, more or less uniformly, over its surface 326 dimples or shallow cavities each about 0.138 inches in diameter (3.5 mm) and about 0.03 inches (0.8 mm) deep. The surface area of the golf ball is approximately 8.76 square inches (5652 $mm^2$). Therefore the density of the cavities is about 37 per square inch ($0.057/mm^2$).

No other application of cavities or dimples of any size or shape to the exterior surface of a vehicle of any sort moving in a gas or liquid or to the interior surface of a conduit through which a fluid flows is known to me.

SUMMARY OF THE INVENTION

Briefly stated the invention comprises the process of constructing a portion of the outer surface of a vehicle which is designed and adapted to move through a fluid. The vehicle is selected from the group consisting of automobile, airplane, missile and boat. The process comprises the step of providing cavities in the portion of the outer surface, the cavities having a shape, a depth and a percent coverage of said portion, whereby movement of the vehicle through the fluid is facilitated.

The invention also comprises a vehicle having an outer surface, including a matrix of cavities dispersed over a portion of the outer surface. The vehicle having such an outer surface portion is selected from the group consisting of automobile, airplane, missile and boat.

BRIEF DESCRIPTION OF THE DRAWINGS

The foregoing summary as well as the following description of preferred embodiments of the present invention will be better understood when read in conjunction with the appended drawings. For the purpose of illustrating the invention there are shown in the drawings, embodiments which are presently preferred, it being understood, however, that the invention is not limited to the specific instrumentalities or the precise arrangements disclosed.

In the drawings.

DETAILED DESCRIPTION OF THE INVENTION

Figure 2:
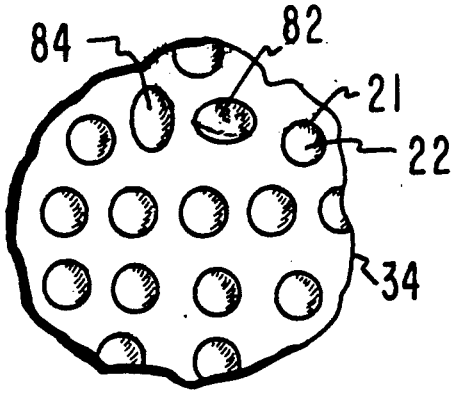
FIGS. 2, 3, 4 and 5 are representations of surfaces containing cavities of the present invention, which cavities are applicable to external surfaces of any of the following prior art vehicles and to the internal surfaces of fluid carrying pipes.
Figure 4:
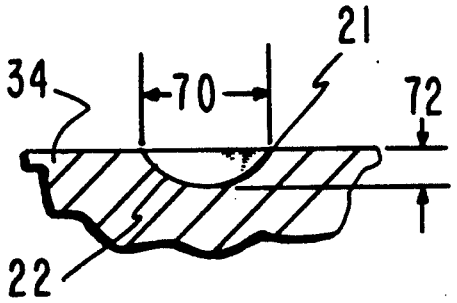
Figure 5:
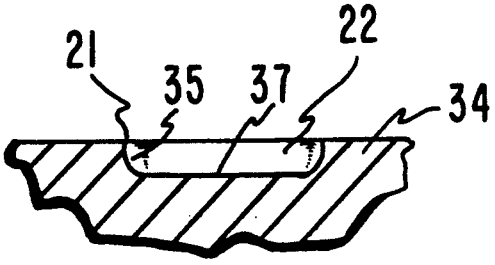

Referring now to the drawings wherein like references are employed to indicate like elements throughout, there is shown in FIG. 2 a planar surface 34. Referring now to FIG. 4 there is shown a crossection of surface 34, the section having been taken through a cavity 21 which is embedded or formed within surface 34. Cavity 21 has a generally spherical surface 22. In another embodiment of the present invention as shown in crossection in FIG. 5, the cavity diameter is large compared to the extent or the thickness of the planar surface. In the cavity 21 of FIG. 5, which is formed in surface 34, the peripheral cavity surfaces 35 positioned adjacent surface 34 are generally spherical. However, to control the depth of the cavity 21 when that cavity is formed in thin skin sections 34, such as are found in airplanes, the spherical surface 35 is truncated by a plane 37, positioned substantially parallel to surface 34.

In FIG. 2 there are shown cavities having similar sizes positioned within surface 34. Round cavities 21 having shape 22, have a diameter 70 and a depth 72 as displayed in detail in the enlarged crossection of a cavity shown in FIG. 4. Oval cavities 62 and 64 have their major axes positioned at right angles to each other.

Figure 3:
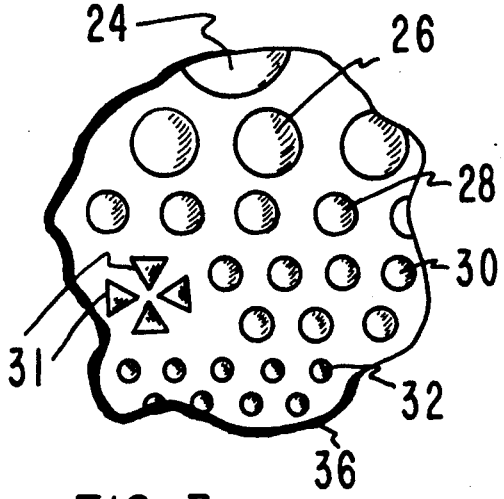

In FIG. 3 there is shown surface 36 having cavity groups 26, 28, 30 and 32 which are applicable to the external surfaces of various vehicles. The groups are distinguished from each other by the cavity size, cavity 26 being the largest and cavity 32 being the smallest. The size and shape of the cavities applied to a vehicle surface are related to the size of the vehicle and the radius of curvature of the surface to which they are to be applied. In one embodiment of the invention, the cavities are equilateral triangles 31, in another embodiment the cavities are polygons with other numbers of sides, typically, 4, 5 or 6. Of the portion of the vehicle having a surface of the present invention, the percent of the surface portion occupied by cavities is about 85 percent, though in other embodiments, the coverage of the surface portion ranges from 95 percent to 30 percent depending on the degree of effectiveness, and where lift is desired, the degree of lift desired.

In vehicles or projectiles having diameters less than 6 inches (152 mm), including projectiles having a diameter as small as 0.3 inches (7.6 mm), a cavity diameter of 8% of the major diameter should be the initial choice. In large vehicles, where the cavities are applied to the leading curvatures of the airfoils, the cavity diameters must be related to the radius of curvature of the leading curvatures. Where the radius of curvatures of the leading curvatures is about 3 inches (76 mm) a cavity diameter equalling 16 percent of the radius should be selected. Typically the cavities range in diameter from 0.010 to 0.75 inches, or if polygonal, measured between the most widely separated vertexes. The cavity depth ranges from 5 percent to 40 percent of the cavity diameter.

Figure 1:
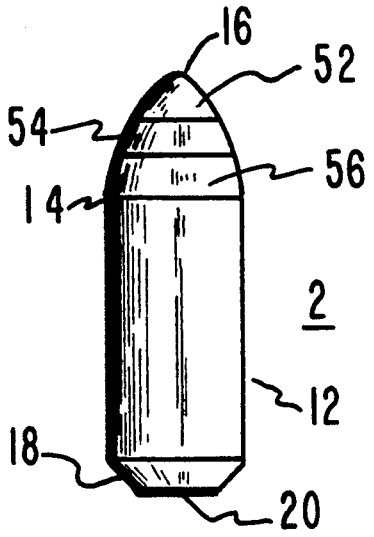
FIG. 1 is a side elevation of a bullet.

Referring now to the projectile of FIG. 1 there is shown a cylindrical portion 12, a tapered end portion 18 called a boat tail, a flat base 20 and a tapered nose portion having three zones; zone 52 which is closest to the tip 16, zone 56, which is closest to the cylindrical portion 12, and zone 54 which is between zones 52 and 56 and contiguous to both. In a first embodiment of the present invention the cavities of FIG. 3 are embedded into the surface of the nose portion of projectile 12. The smallest cavities 32 are embossed into the conical zone 52, closest to the tip 16 of the projectile. These cavities 32 have a diameter which is 8 percent of the diameter of the projectile at the transition from zone 52 to zone 54. Larger cavities 30 are embossed into zone 54. These cavities have a diameter 8 percent of the largest diameter of zone 54. Still larger cavities 28 are embossed into the surface of projectile zone 56. These cavities 28 have a diameter 8 percent the largest diameter of zone 56. In other embodiments the cavities have a diameter ranging from 1 percent to 10 percent of the projectile diameter.

In particular, where the projectile of FIG. 1 has a diameter of 0.511 inches (13 mm) at cylindrical portion 12, round cavities having a diameter at zone 52 of 0.013 inches (0.33 mm), at zone 54 of 0.026 inches (0.66 mm) and at zone 56 of 0.041 inches (1.04 mm), all with 50 percent coverage, are employed.

For ease of manufacture, in another embodiment of the invention, cavities having only one diameter, the diameter being either the smallest or an intermediate size, are applied to all three zones 52, 54 and 56. In another embodiment of the present invention nose portions 52, 54 and 56 of projectile 12 are rounded and the rounded nose portion includes cavities of the same or varying size dispersed over the nose portion area. In still another embodiment of the present invention, cavities are dispersed over the entire surface of the projectile 12 including the cylinder portion 12 and the boat tail portion 18.

Where the projectile is formed of a low melting alloy such as tin/lead or type setting alloy, the cavities are applied to the projectile by machining their form into the mold employed for casting the projectile. Where the projectile material is not suitable for casting, the cavities are rolled, swaged or stamped into the projectile surface. The method of manufacture of the surface embodying the cavities is not part of the present invention.

Figure 6:
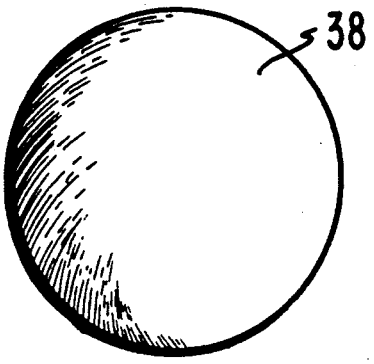
FIG. 6 is a side elevation of a ball shaped projectile.
Figure 7:
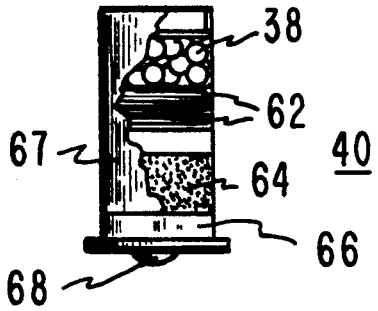
FIG. 7 is a side elevation in partial crossection of a cartridge of the type employed in shotguns. The cartridge is charged with multiple pellets.

FIG. 6 displays a single pellet 38 of the type used in a shotshell 40 of the type shown in partial crossection in FIG. 7. The shot shell has a casting 67, generally made of paper or plastic, a base 66 made either of metal or molded of the same material as the case, and a primer 68 embedded in a cavity in the base 66. Within the shell is powder 64, one or more wads 62 and a number of pellets 38, one of which is shown greatly enlarged in FIG. 6. The end of the shotshell 40 is closed by folding over and crimping excess length provided in the casing 67 for this purpose. The pellets 38 have long been made only of lead or of lead alloyed with antimony for hardness. Pellets for shotshell have numbered sizes ranging from #12 having 0.050 inch (1.3 mm) diameter through #2 having 0.150 inch (3.8 mm) diameter. Larger pellets are Air Rifle and BB which are 0.175 and 0.180 inches (4.4 and 4.6 mm) respectively. Buck shot used primarily for hunting ranges from #4 buck which is 0.24 inches (6.1 mm) diameter to #00 buck which is 0.33 inches (8.4 mm) diameter. The shot made with the antimony alloy is called chilled shot. More recently, federal laws have required duck hunters to employ steel shot. Steel shot is lighter than lead or chilled shot of the same diameter. Therefore it tends to lose velocity faster than lead based shot and to have less energy at the point of impact on the game. Providing cavities in the surface of the shot reduces air resistance and provides higher terminal velocity, therefore higher striking energy and greater effectiveness in killing the game. Since striking energy is related to the square of the velocity, even a small increase in striking velocity results in a marked increase in striking energy. For example, a 5 percent increase in velocity provides a 10 percent increase in striking energy. A 20 percent increase in strike velocity results in a 44 percent increase in strike energy.

In one embodiment of the present invention, number 00 buck shot is embossed with round cavities, each having a diameter of 0.026 inches (0.66 mm), and spaced to provide 60 percent coverage.

Cavities in the surface of shot increases the shot's ability to penetrate multiple pages of a given phone book. At 40 yards (36.6 meters) a 12 gage load of 1⅛ ounce (31.9 grams) of #2 chilled lead shot having cavities in accord with the invention, over 23 grains (1.5 grams) Red Dot powder (Hercules trade name) penetrated, on the average, 22 percent more pages of the phone book than standard chilled shot fired at the same book with the same distance, wads and powder charge. Pattern tests conducted at 15 yards (13.7 meters) with the same shotgun bored full choke showed more uniform and tighter patterns were achieved with the cavitied shot made in accord with the present invention, than with the standard shot, though no numerical evaluation was made.

Figure 8:
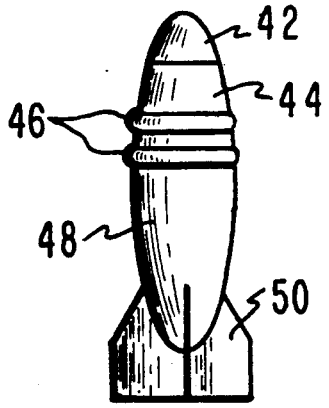
FIG. 8 is a side elevation of a projectile used in mortars.

FIG. 8 shows a side elevation of an explosive shell intended to be fired from a mortar. Application of cavities, in accordance with the teaching of the present invention, to the nose surfaces of the shell 42 and 44 and to the fin surfaces 50 would significantly extend the range obtainable with a given propellant charge. In another embodiment of the present invention applicable to the mortar shell of FIG. 8, the entire shell surface including after surface 48, is covered by the cavities.

In one embodiment of the present invention, a mortar shell having a body diameter of 4 inches (102 mm) has round cavities embossed into the surfaces 42 and 44. The cavities have a diameter of 0.100 inches (2.54 mm) and are spaced to provide 70 percent coverage.

In another embodiment of the present invention the mortar shell has equilateral triangular shaped cavities having sides 0.100 inches in length and having 90 percent coverage.

Figure 9:
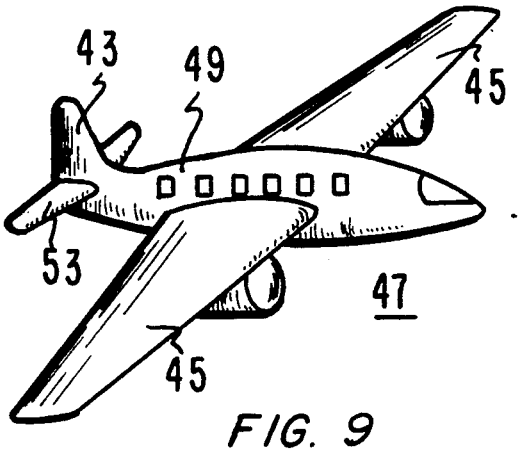
FIG. 9 is a view in perspective of an airplane.

FIG. 9 displays an airplane whose external surfaces are completely covered with skin having cavities exemplified by FIGS. 2 and 4. The reduction in air resistance provided by the cavities generates the advantages of higher speeds and increased range for the same fuel load. In other embodiments of the present invention only the upper surface 45 of the wings are covered with cavities, thereby providing additional lift.

In one embodiment of the present invention as applied to the skin of airplanes, equilateral hexagonal cavities having a dimension 0.200 inches (5.1 mm), measured across two most widely separated vertices, are spaced to provide 40 percent coverage. The cavities have the form of FIG. 5 and have a cavity depth of 0.010 inches (0.25 mm).

Figure 10:
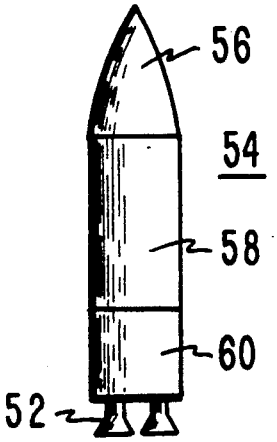
FIG. 10 is a side elevation of a ballistic missile.

In FIG. 10 is shown a ballistic missile 54, having in one embodiment of the present invention, cavities covering only the nose surface 56. In other embodiments of the present invention, selected portions of the missile such as the nose portion 56, the body portion 58 or the aft portion, 60 are covered with cavities. The effect of the cavities on the skin during movement at trans-sonic velocities is not known.

Figure 11:
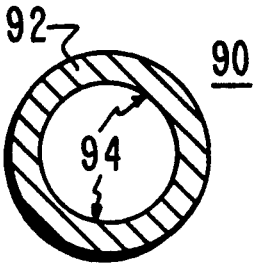
FIG. 11 is a crossection of a fluid carrying pipe.

In FIG. 11 is shown a crosssection of a pipe 90 for conveying a fluid. The pipe 90 has a wall 92 having an interior surface 94. The interior surface 94 is provided with cavities sized and positioned in accord with the present invention, thereby providing lower pressure drop and reduced energy loss attributable to such flow. Since pipe sizes are generally selected based on the pressure drop expected for the pipe length required, a concomitant advantage is that a reduced pipe size, having an internal surface manufactured in accord with my invention, may be employed in some cases compared with standard pipes having smooth internal surfaces.

In one embodiment of the present invention a water carrying pipe having a 4 inch inside diameter (102 mm) has round internal cavities having a diameter of 0.200 inches, spaced to provide 25 percent coverage.

Figure 12:
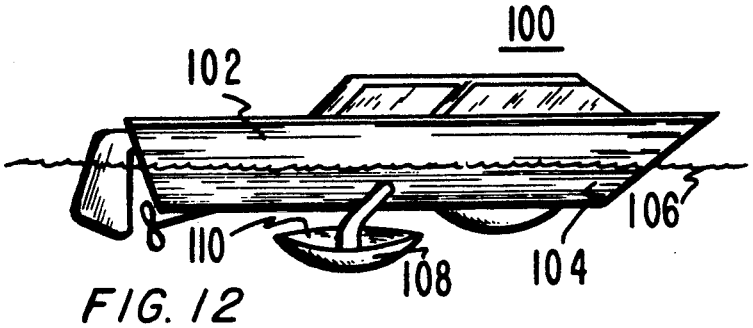
FIG. 12 is a boat.

The boat 100 of FIG. 12 has a waterline 106 dividing the hull into an above waterline portion 102 and a submerged portion 104. Cavities of the present invention as described in connection with FIGS. 2 through 5, are applied to submerged hull surface 104 to facilitate the movement of the boat through the water, thereby increasing boat speed and reducing fuel consumption.

In another embodiment of the present invention as applied to a boat 100 equipped with hydrofoils 108 which enable the displacement hull of the boat to be lifted out of the water during forward motion, the required lift is effectuated by dimpling the upper surfaces 110 of the foil and decreasing the angle of attack. With this construction, the required lift is achieved with a much lower drag coefficient.

From the foregoing description it can be seen that the present invention comprises an advanced surface for vehicles moving within a gaseous environment and reduced pressure drops and energy losses for pipes employing the advanced surface. It will be appreciated by those skilled in the art that changes could be made to the above-described embodiments without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A projectile intended to be fired from a gun, said projectile comprising a substantially cylindrical body portion having a diameter, said body portion having an axis and a first surface; a tapered nose portion having a second surface and a tip, the nose portion being positioned adjacent to and coaxially aligned with respect to the body portion, and the tip being positioned on the axis of and furthest from the body portion; and further including a matrix of cavities applied to the surface of the nose portion, said cavities having a shape and a size, the size of said cavities decreasing from the largest adjacent the body portion to the smallest adjacent the tip.

2. A projectile as recited in claim 1 where the cavities applied to the second surface have the shape of a polygon having three or more apexes separated by distances and the size is the distance between the most widely separated apexes within a polygon.

3. A projectile as recited in claim 2 where a matrix of cavities is applied also to the first surface.

4. A projectile as recited in claim 1 where the cavities have a substantially round shape and the size is the diameter.

5. A projectile as recited in claim 4 where a matrix of cavities is applied also to the first surface.

* * * * *